US007834736B1

(12) United States Patent
Johnson et al.

(10) Patent No.: US 7,834,736 B1
(45) Date of Patent: Nov. 16, 2010

(54) DRY TYPE POLE-MOUNTED TRANSFORMER

(75) Inventors: Charles W. Johnson, Wytheville, VA (US); Joel A. Kern, Wytheville, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/533,450

(22) Filed: Jul. 31, 2009

(51) Int. Cl.
*H01F 27/28* (2006.01)

(52) U.S. Cl. ..... 336/229; 336/5; 336/225; 336/182

(58) Field of Classification Search ..... 336/225, 336/229, 12, 15, 5, 182
See application file for complete search history.

(56) References Cited

U.S. PATENT DOCUMENTS

| | | | | |
|---|---|---|---|---|
| 3,242,446 | A * | 3/1966 | Leute | 336/96 |
| 3,451,023 | A | 6/1969 | Aveyard et al. | |
| 3,612,798 | A * | 10/1971 | Barton et al. | 218/82 |
| 3,662,461 | A | 5/1972 | Lake et al. | |
| 3,737,823 | A | 6/1973 | Mees et al. | |
| 3,833,182 | A | 9/1974 | Wilcox et al. | |
| 3,925,744 | A * | 12/1975 | Canney | 336/84 R |
| 3,996,544 | A | 12/1976 | Mori et al. | |
| 4,009,306 | A * | 2/1977 | Yamashita et al. | 427/374.4 |
| 4,117,525 | A * | 9/1978 | Moore | 361/37 |
| 4,205,290 | A * | 5/1980 | Canney et al. | 336/90 |
| 4,471,337 | A | 9/1984 | Mausz et al. | |
| 4,488,134 | A | 12/1984 | Pfeiffer | |
| 4,524,342 | A | 6/1985 | Mas | |
| 4,779,812 | A | 10/1988 | Fisher et al. | |
| 6,201,334 | B1 | 3/2001 | Sargeant et al. | |
| 6,624,360 | B2 * | 9/2003 | Meinherz | 174/152 R |
| 7,023,312 | B1 | 4/2006 | Lanoue et al. | |
| 2002/0033748 | A1 * | 3/2002 | Bolotinsky et al. | 336/182 |
| 2008/0007378 | A1 | 1/2008 | Hanser | |
| 2009/0174518 | A1 * | 7/2009 | Chang | 336/229 |

FOREIGN PATENT DOCUMENTS

JP 8321231 A * 5/1995

* cited by examiner

*Primary Examiner*—Anh T Mai
(74) *Attorney, Agent, or Firm*—Paul R. Katterle

(57) ABSTRACT

A distribution transformer adapted for mounting to a utility pole. The distribution transformer includes a plurality of coil assemblies mounted to a ferromagnetic core. Each of the coil assemblies includes a low voltage coil and a high voltage coil. The low voltage coils are connected together and the high voltage coils are connected together. An encasement comprised of an insulating resin encapsulates the core and the coil assemblies. The encasement includes a substantially annular body and a pair of high voltage bushings extending outwardly from the body. Terminals extend from the high voltage bushings and are connected to the high voltage coils.

20 Claims, 8 Drawing Sheets

DRY TYPE POLE-MOUNTED TRANSFORMER

BACKGROUND OF THE INVENTION

The present invention relates to transformers and more particularly to pole-mounted distribution transformers.

Power is often provided from utilities to residences and small businesses from distribution transformers mounted to utility poles. Conventionally, such pole-mounted distribution transformers include a core and coil assembly mounted in a tank filled with a hydrocarbon-based dielectric fluid. Anomalous events, such as lightning strikes and traffic accidents, can result in the tank being compromised and the dielectric fluid spilling into the surrounding area, which presents environmental issues. For this and other reasons it would be desirable to provide a pole-mounted distribution transformer that does not contain a dielectric fluid, i.e., is a dry-type transformer. A conventional dry-type distribution transformer, however, is typically unsuitable for use as a pole-mounted distribution transformer for a number of reasons, including its environmental hardiness, i.e., its ability to withstand direct sunlight, rain, snow etc. Environmentally hardening a conventional dry-type distribution would unacceptably increase its size and/or its cooling ability. The present invention is directed to a dry-type transformer that is suitable for use as pole-mounted distribution transformer.

SUMMARY OF THE INVENTION

In accordance with the present invention, a distribution transformer is provided and includes a plurality of coil assemblies mounted to a ferromagnetic core. Each of the coil assemblies includes a low voltage coil and a high voltage coil. The low voltage coils are connected together and the high voltage coils are connected together. An encasement comprised of an insulating resin encapsulates the core and the coil assemblies. The encasement includes a body having a central passage extending therethrough and a pair of high voltage bushings extending outwardly from the body. Terminals extend from the high voltage bushings and are connected to the high voltage coils.

Also provided in accordance with the present invention is a power distribution installation comprising the above-described transformer mounted to a utility pole.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
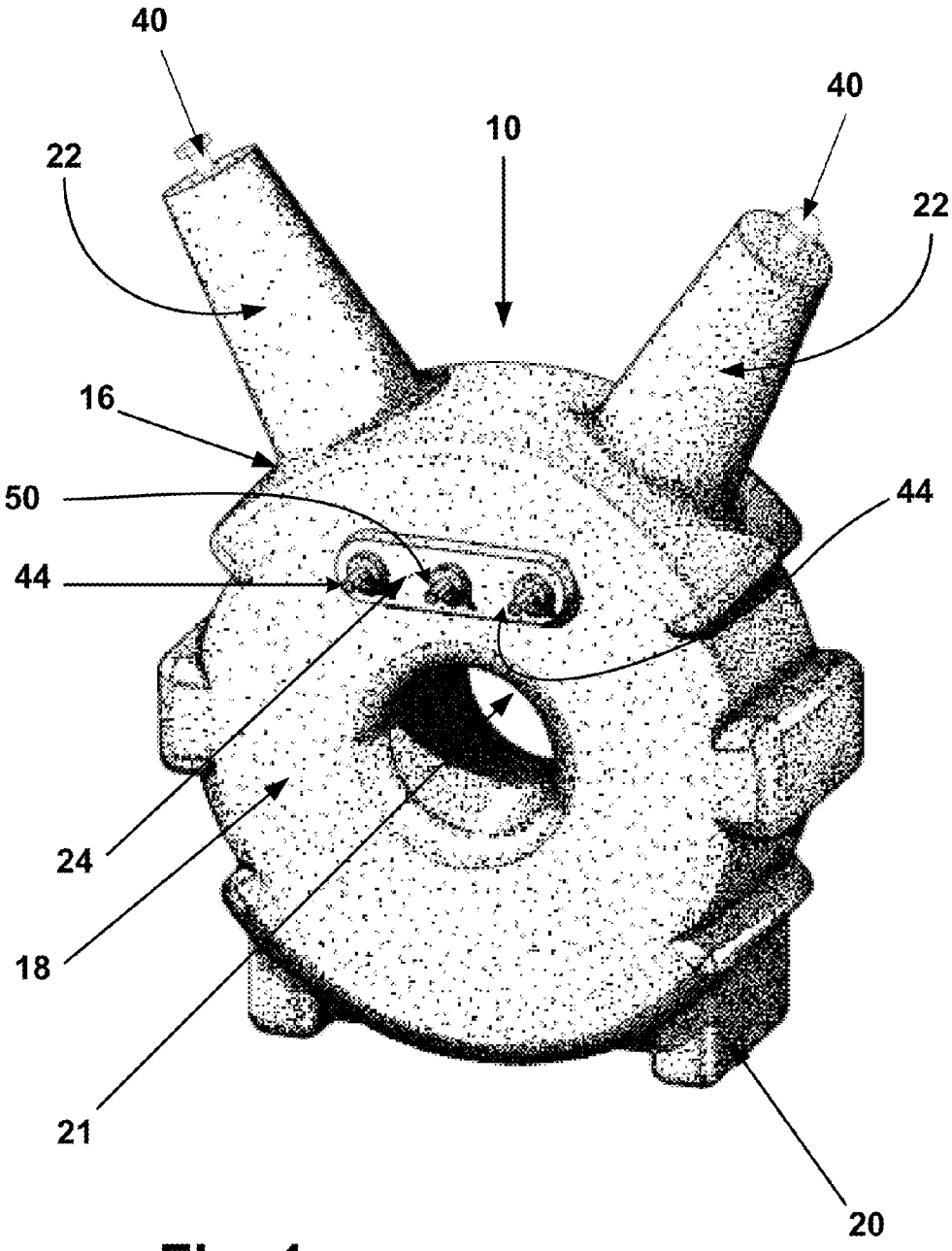
FIG. 1 is a front perspective view of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in som what schematic form.

The present invention is directed to a single-phase distribution transformer 10 that is adapted for mounting to a utility pole and provides power to residences and small businesses. As such, the transformer 10 is a step-down transformer that receives an input voltage and steps it down to a lower, output voltage. The transformer has a rating from about 16 kVA to 500 kVA, with an input voltage in a range from 2,400 to 34,500 Volts and an output voltage in a range from 120 to 600 Volts. The transformer 10 generally includes a plurality of winding modules 12 mounted to a ferromagnetic core 14, all of which are disposed inside an encasement 16 formed from one or more resins, as will be described more fully below. The core 14 and the winding modules 12 mounted thereto are cast into the resin(s) so as to be encapsulated within the encasement 16.

Figure 2:
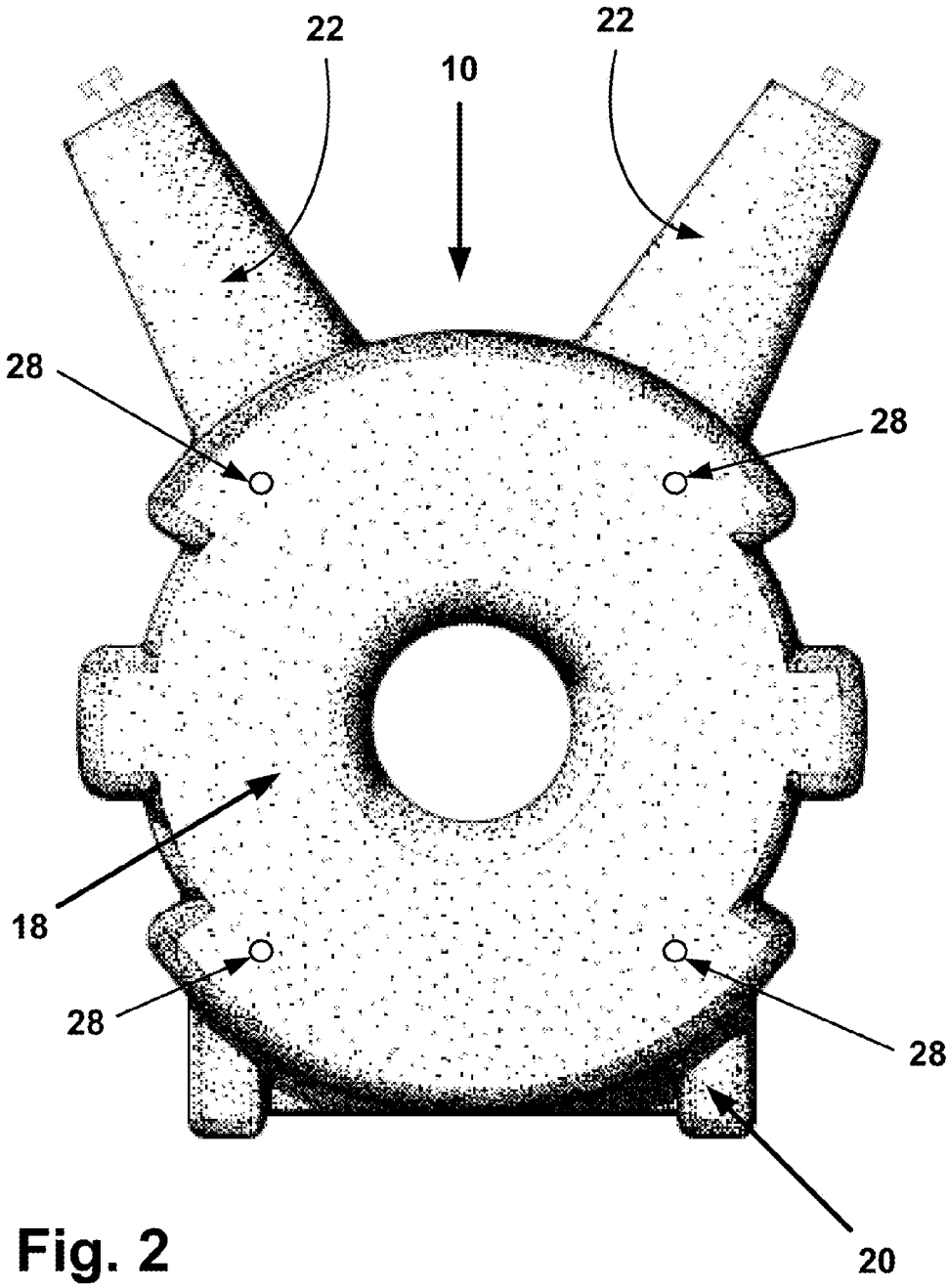
FIG. 2 is a rear elevational view of the transformer.

The encasement 16 includes a generally annular body 18 joined to a base 20. The body 18 has a center passage 21 extending therethrough and a periphery with notches formed therein. A pair of frusto-conical high voltage bushings 22 extend upwardly and outwardly from a top portion of the body 18. A low voltage terminal pad 24 is joined to a front surface of the body 18, above the center passage 21. As shown in FIG. 2, a plurality of mounting inserts 28 project from a rear surface of the body 18 and are located at positions disposed around the center opening. More specifically, the mounting inserts 28 are located at about 1, 5, 7 and 11 O'clock using a clock hand analogy. The mounting inserts 28 may be helically threaded.

The core 14 is composed of a ferromagnetic material, such as iron or steel, and has an inner opening and a closed periphery. The core 14 may have a rectangular frame shape or an annular shape (as shown), such as a toroid. The core 14 may be comprised of a strip of steel (such as grain-oriented silicon steel), which is wound on a mandrel into a coil. Alternately, the core 14 may be formed from a stack of plates, which may be rectangular or annular and of the same or varying width or circumference, as the case may be.

Figure 3:
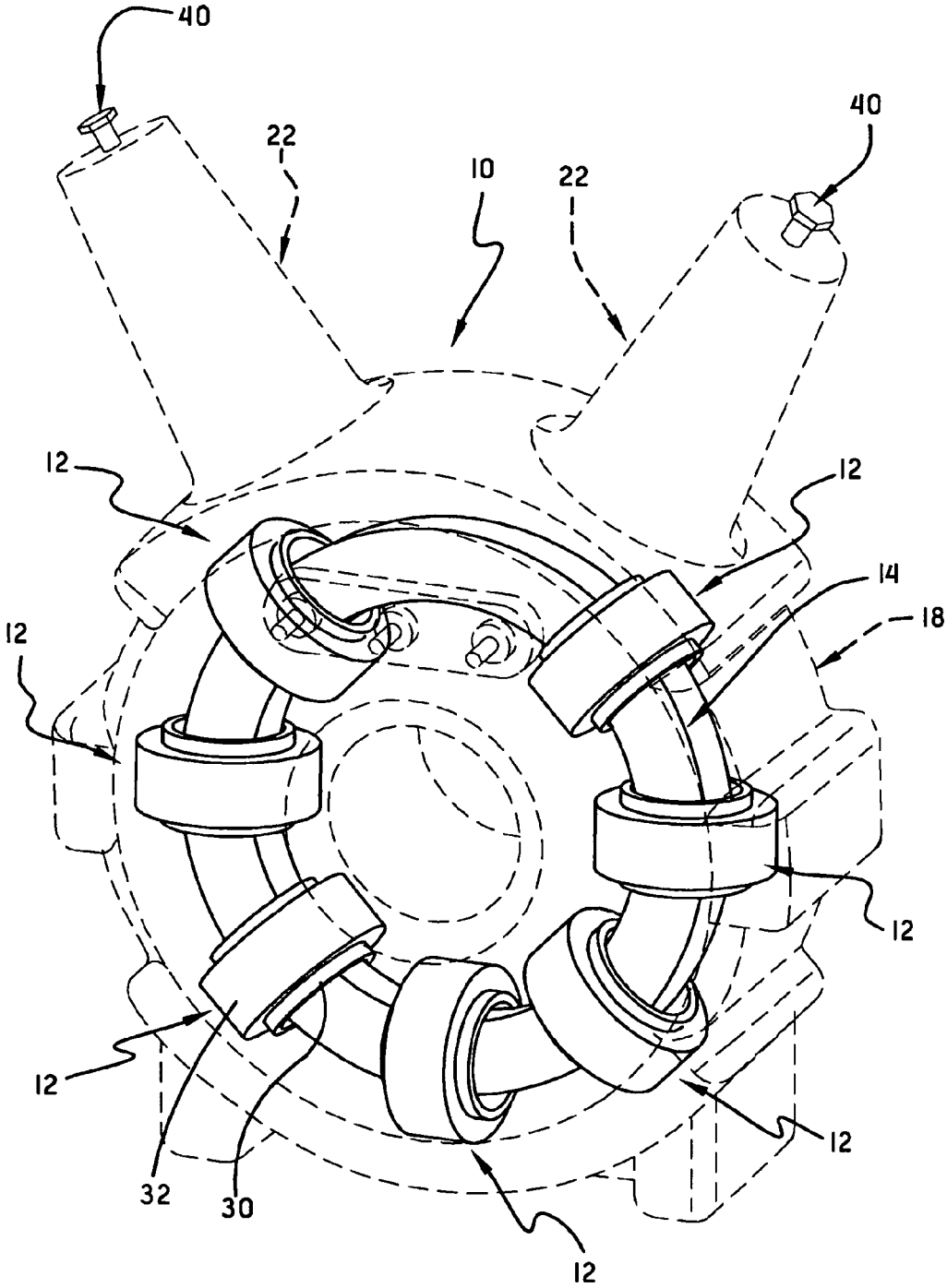
FIG. 3 is a front perspective view of a core and coil assembly of the transformer with an outer encasement of the transformer shown in phantom.
Figure 4:
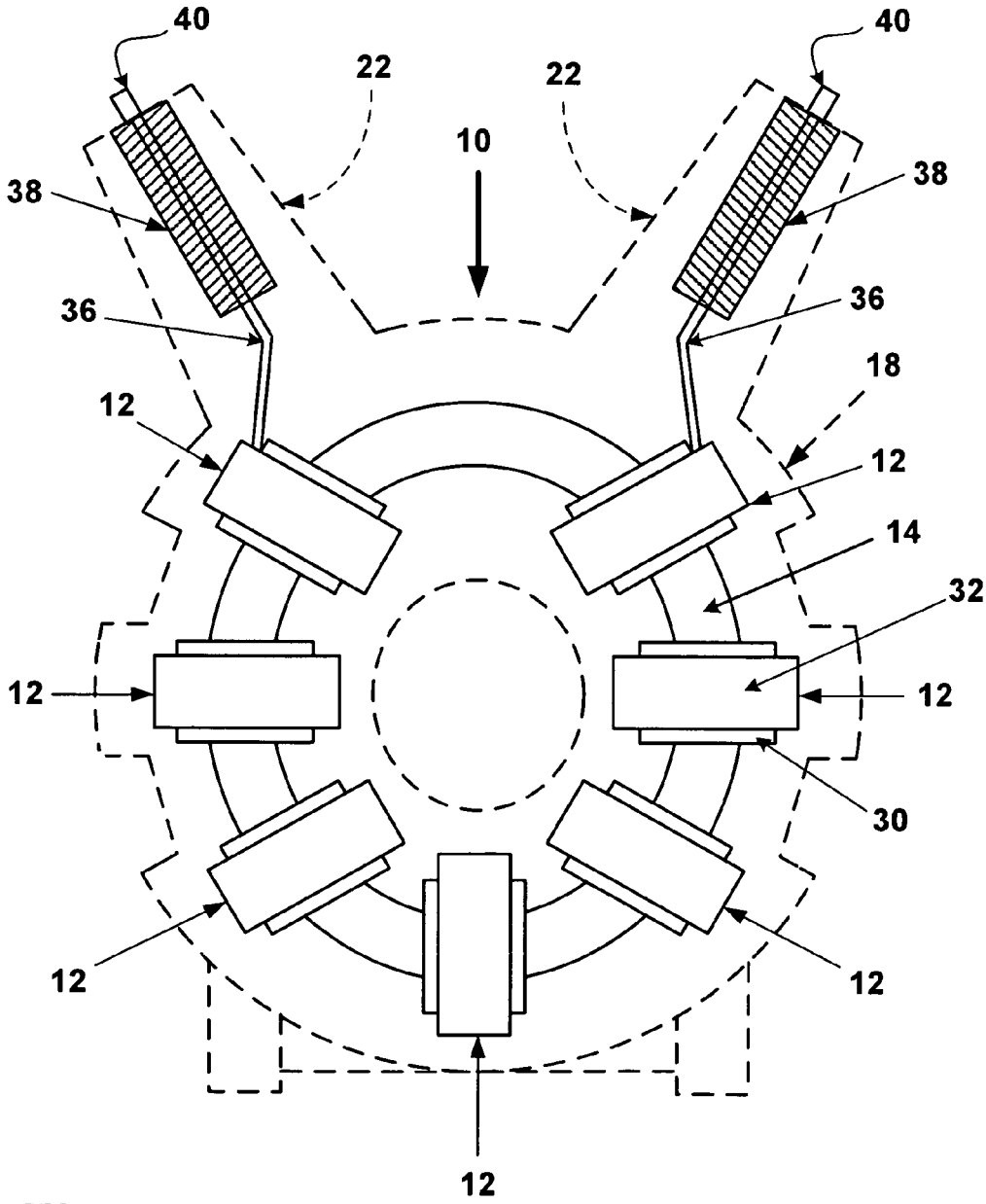
FIG. 4 is a view of the interior of the transformer with an outer encasement of the transformer shown in phantom.

As shown in FIGS. 3 and 4, a plurality of winding modules 12 are mounted to the core 14 in a spaced-apart fashion. Although seven winding modules 12 are shown in FIG. 3, it should be appreciated that a different number of winding modules 12 may be provided without departing from the scope of the present invention. Each winding module 12 includes a low voltage winding segment 30 mounted concentrically inside a high voltage winding segment 32. The low voltage winding segment 30 and the high voltage winding segment 32 may each be cylindrical in shape. Each of the low and high voltage winding segments 30, 32 may be formed using a layer winding technique, wherein a conductor is wound in one or more concentric conductor layers connected in series. The low voltage winding segment 30 may have a longer axial length than the high voltage winding segment 32, as is shown. The conductor may be foil strip(s), sheet(s), or wire with a rectangular or circular cross-section. The conductor may be composed of copper or aluminum. A layer of insulation material is disposed between each pair of conductor layers.

The winding modules 12 may be wound directly on the core 14. Alternately, the winding modules 12 may be formed on a mandrel and then mounted to the core 14 if the core 14 is formed with a gap or is formed from several pieces that are secured together after the winding modules 12 are mounted thereto.

The low voltage winding segments 30 of the winding modules 12 are electrically connected together (either in series or in parallel) by conductors to form a low voltage winding. Similarly, the high voltage winding segments 32 are electrically connected together (either in series or in parallel) by conductors to form a high voltage winding.

Ends of the high voltage winding formed by the segments 32 are connected to leads 36, which extend through the body 18 and are secured to terminals 40 fixed to the ends of the high voltage bushings 22. Helical coils 38 may be disposed inside the high voltage bushings 22, respectively. Each coil 38 is comprised of conductive wire that is helically wound to form a cylinder having a central passage. The conductive wire may or may not be encased in an insulating covering. Outer ends of the conductive wires are secured to the terminals 40, respectively. Inner ends of the conductive wires are folded inwardly so as to be disposed inside the central passages, respectively. The leads 36 extend through the central passages of the coils 38. In this manner, the coils 38 are disposed around and spaced from the leads 36. The coils 38 control the electrical fields that may be generated when current passes through the leads 36 and thereby reduce the dielectric stress on the resin material of the high voltage bushings 22.

Figure 7:
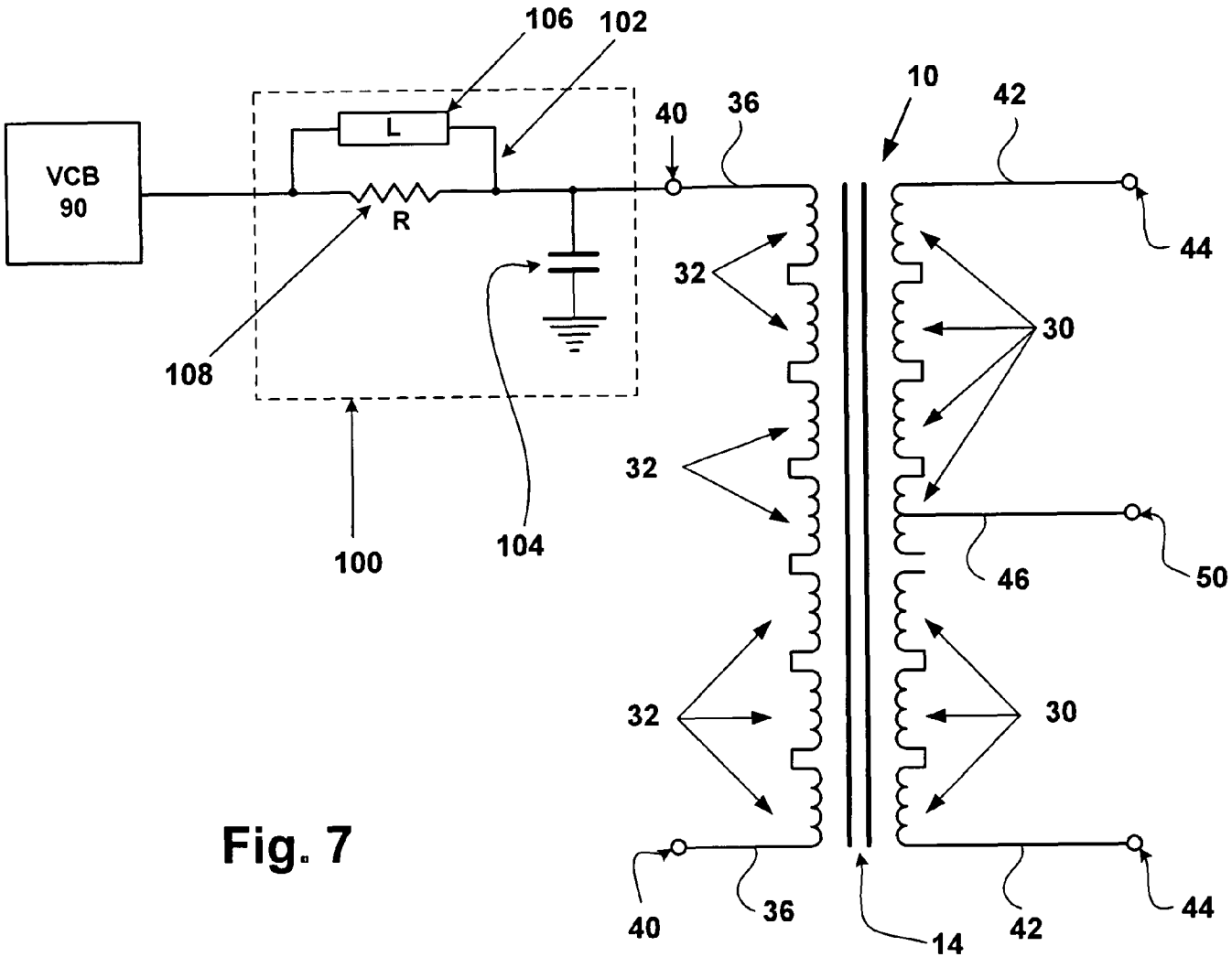
FIG. 7 is a circuit diagram of the transformer connected to a choke.

As schematically shown in FIG. 7, ends of the low voltage winding formed by the segments 30 are connected to leads 42, which extend through the body 18 and are secured to terminals 44 that extend from the terminal pad 24. A center tap on the low voltage winding is connected by a lead 46 to a neutral terminal 50 that extends from the terminal pad 24. The neutral terminal 50 is connected to ground. The terminals 44 and 50 provide connections for a single-phase, three-wire distribution system. The voltage between the terminals 44 may be 240 Volts, while the voltage between one of the terminals 44 and the terminal 50 is 120 Volts.

The interconnected winding modules 12 mounted to the core 14, together with the leads 36, 42, 46 and the coils 38 form an electrical assembly that is cast into one or more insulating resins that is/are cured to form the encasement 16.

The encasement 16 may be formed from a single insulating resin, which may be butyl rubber or an epoxy resin. In one embodiment, the resin is a cycloaliphatic epoxy resin, still more particularly a hydrophobic cycloaliphatic epoxy resin composition. Such an epoxy resin composition may comprise a cycloaliphatic epoxy resin, a curing agent, an accelerator and, optionally, filler, such as silanised quartz powder, fused silica powder, or silanised fused silica powder. The curing agent may be an anhydride, such as a linear aliphatic polymeric anhydride, or a cyclic carboxylic anhydride. The accelerator may be an amine, an acidic catalyst (such as stannous octoate), an imidazole, or a quaternary ammonium hydroxide or halide.

The encasement 16 may be formed from the resin composition in an automatic pressure gelation (APG) process. In accordance with APG process, the resin composition (in liquid form) is degassed and preheated to a temperature above 40° C., while under vacuum. The electrical assembly is placed in a cavity of a mold heated to an elevated curing temperature of the resin. The leads 36, 42, 46 and the mounting inserts 28 extend out of the cavity through openings so as to protrude from the encasement 16 after the casting process. The degassed and preheated resin composition is then introduced under slight pressure into the cavity containing the electrical assembly. Inside the cavity, the resin composition quickly starts to gel. The resin composition in the cavity, however, remains in contact with pressurized resin being introduced from outside the cavity. In this manner, the shrinkage of the gelled resin composition in the cavity is compensated for by subsequent further addition of degassed and preheated resin composition entering the cavity under pressure. After the resin composition cures to a solid, the solid encasement 16 with the electrical assembly molded therein is removed from the mold cavity. The encasement 16 is then allowed to fully cure.

It should be appreciated that in lieu of being formed pursuant to an APG process, the encasement 16 may be formed using an open casting process or a vacuum casting process. In an open casting process, the resin composition is simply poured into an open mold containing the electrical assembly and then heated to the elevated curing temperature of the resin. In vacuum casting, the electrical assembly is disposed in a mold enclosed in a vacuum chamber or casing. The resin composition is mixed under vacuum and introduced into the mold in the vacuum chamber, which is also under vacuum. The mold is heated to the elevated curing temperature of the resin. After the resin composition is dispensed into the mold, the pressure in the vacuum chamber is raised to atmospheric pressure.

In another embodiment of the present invention, the encasement 16 has two layers formed from two different insulating resins, respectively, and is constructed in accordance with PCT Application No.: WO2008127575, which is hereby incorporated by reference. In this embodiment, the encasement 16 comprises an inner layer or shell and an outer layer or shell. The outer shell is disposed over the inner shell and is coextensive therewith. The inner shell is more flexible (softer) than the outer shell, with the inner shell being comprised of a flexible first resin composition, while the outer shell being comprised of a rigid second resin composition. The first resin composition (when fully cured) is flexible, having a tensile elongation at break (as measured by ASTM D638) of greater than 5%, more particularly, greater than 10%, still more particularly, greater than 20%, even still more particularly, in a range from about 20% to about 100%. The second resin composition (when fully cured) is rigid, having a tensile elongation at break (as measured by ASTM D638) of less than 5%, more particularly, in a range from about 1% to about 5%.

The first resin composition of the inner shell may be a flexible epoxy composition, a flexible aromatic polyurethane composition, butyl rubber, or a thermoplastic rubber. The second resin composition of the outer shell is a cycloaliphatic epoxy composition, such as that described above. The encasement 16 is formed over the electrical assembly using first and second casting processes. In the first casting process, the inner shell is formed from the first resin composition in a first mold. If the first resin composition is a flexible epoxy composition, the first casting process may be an APG process, or a vacuum casting process. If the first resin composition is a flexible aromatic polyurethane composition, the first casting process may be an open casting process or a vacuum casting process. The second casting process is an APG process or a vacuum casting process. In the second casting process, the intermediate product comprising the electrical assembly inside the inner shell is placed in a second mold and then the second resin composition is introduced into the second mold.

After the second resin composition (the outer shell) cures for a period of time to form a solid, the encasement 16 with the electrical assembly disposed therein is removed from the second mold. The outer shell is then allowed to fully cure.

In lieu of forming the encasement 16 in the foregoing manner, the encasement 16 may be formed by forming the outer shell first and then using the outer shell as a mold for molding the inner shell over the electrical assembly.

Figure 5:
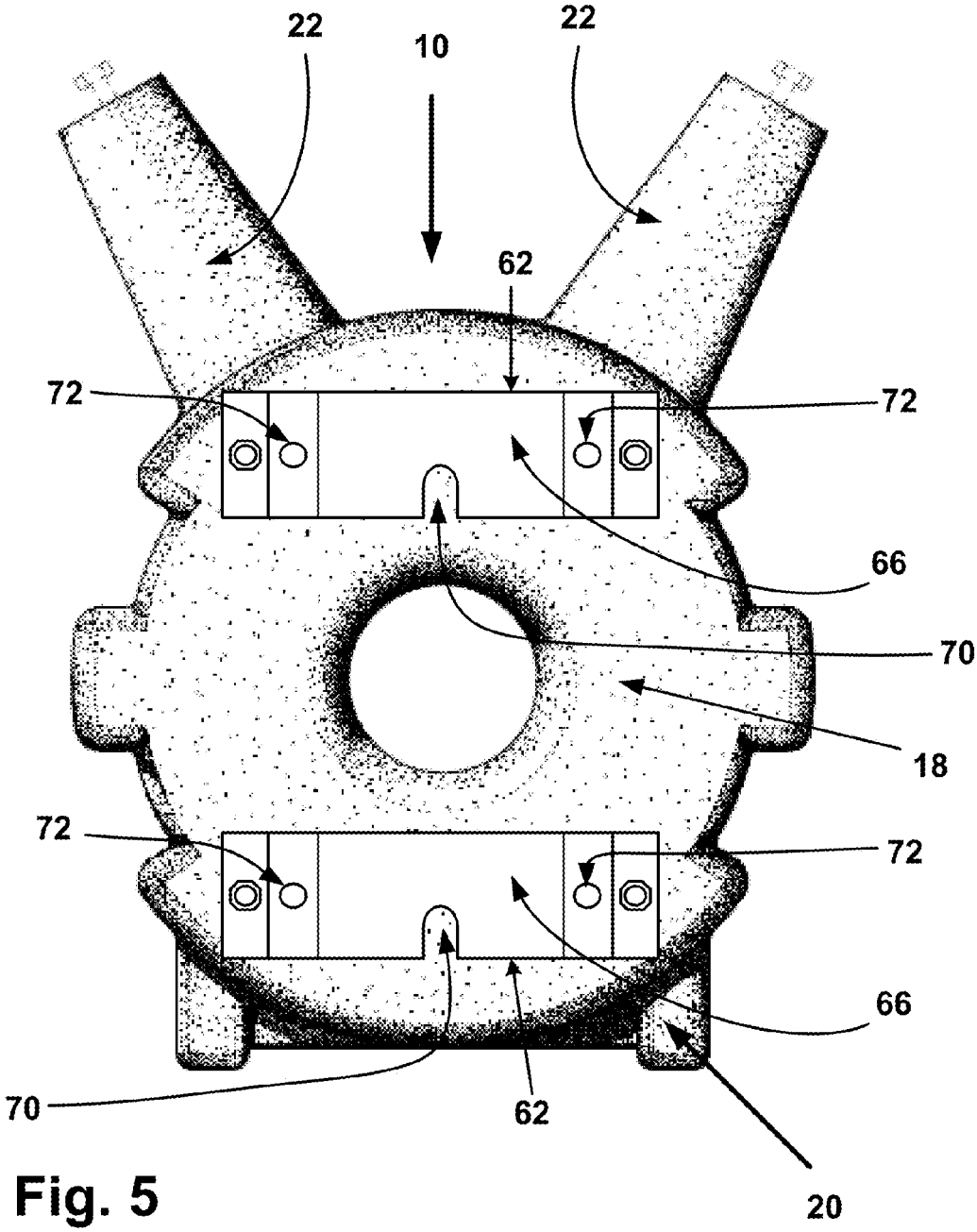
FIG. 5 is a rear elevational view of the transformer with brackets mounted thereto.
Figure 6:
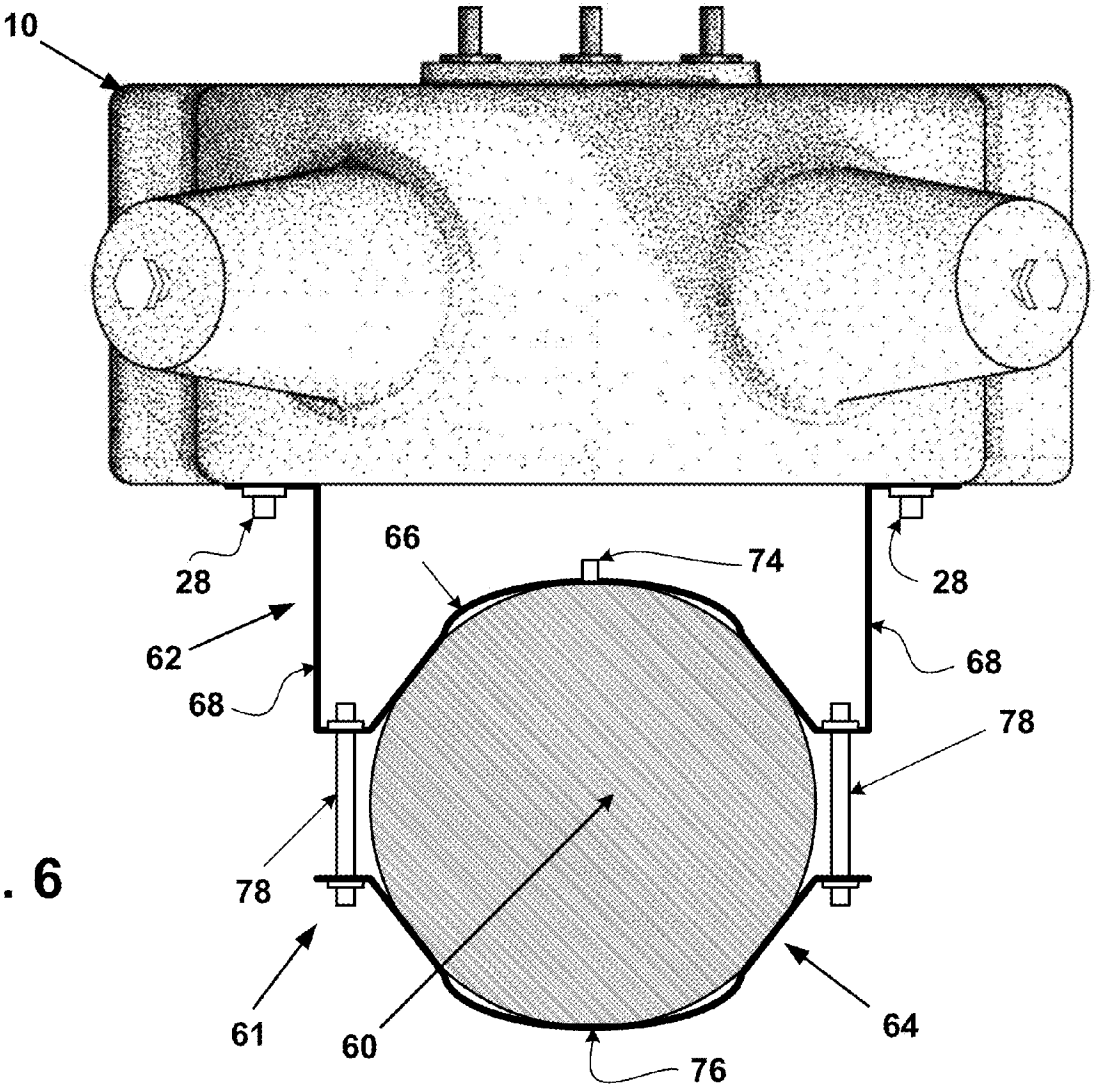
FIG. 6 is a top view of the transformer mounted to a utility pole, with a top portion of the utility pole cut away.

The transformer 10 is adapted to be mounted to a utility pole that extends upright from the ground and supports power lines carrying power from a power generation plant. The transformer 10 may be mounted to such a utility pole in a variety of different ways. Referring now to FIGS. 5 and 6, the transformer 10 may be mounted to a utility pole 60 by a frame 61 comprising an upper combination of a bracket 62 and a clamp 64 and a lower combination of a bracket 62 and a clamp 64. Each bracket 62 includes a bowed body 66 joined between a pair of L-shaped legs 68. In each bracket 62, a notch 70 is formed in the center of the body 66, between a pair of mounting holes 72. The legs 68 of the brackets 62 are secured to the mounting inserts 28 of the transformer 10, respectively.

The transformer 10 is supported on the utility pole 60 by a pair of posts 74 that extend from the utility pole 60 and pass through the notches 70 of the brackets 62, respectively. Interior top edges of the bodies 66 inside the notches 70 rest on the posts 74. The bodies 66 of the brackets 62 extend partially around the utility pole 60 as do bowed bodies 76 of the clamps 64. In each of the upper and lower combinations, the bracket 62 is secured to the clamp 64 by a pair of elongated bolts 78 that extend through the mounting holes 72 of the body 66. With this arrangement, the utility pole 60 is clamped between the bracket 62 and the clamp 64.

It should be appreciated that the transformer 10 may be mounted to the utility pole 60 without the clamps 64 and using just the brackets 62.

When the transformer 10 is mounted to the utility pole 60 as described above, the transformer 10 is elevated above the ground. Power lines carrying power from a power generating station are supported by the utility pole 60 and are connected to the terminals 40 extending from the high voltage bushings 22. The combination of the transformer 10 and the utility pole 60 forms a power distribution installation that can provide power to a residence or a small business.

Figure 8:
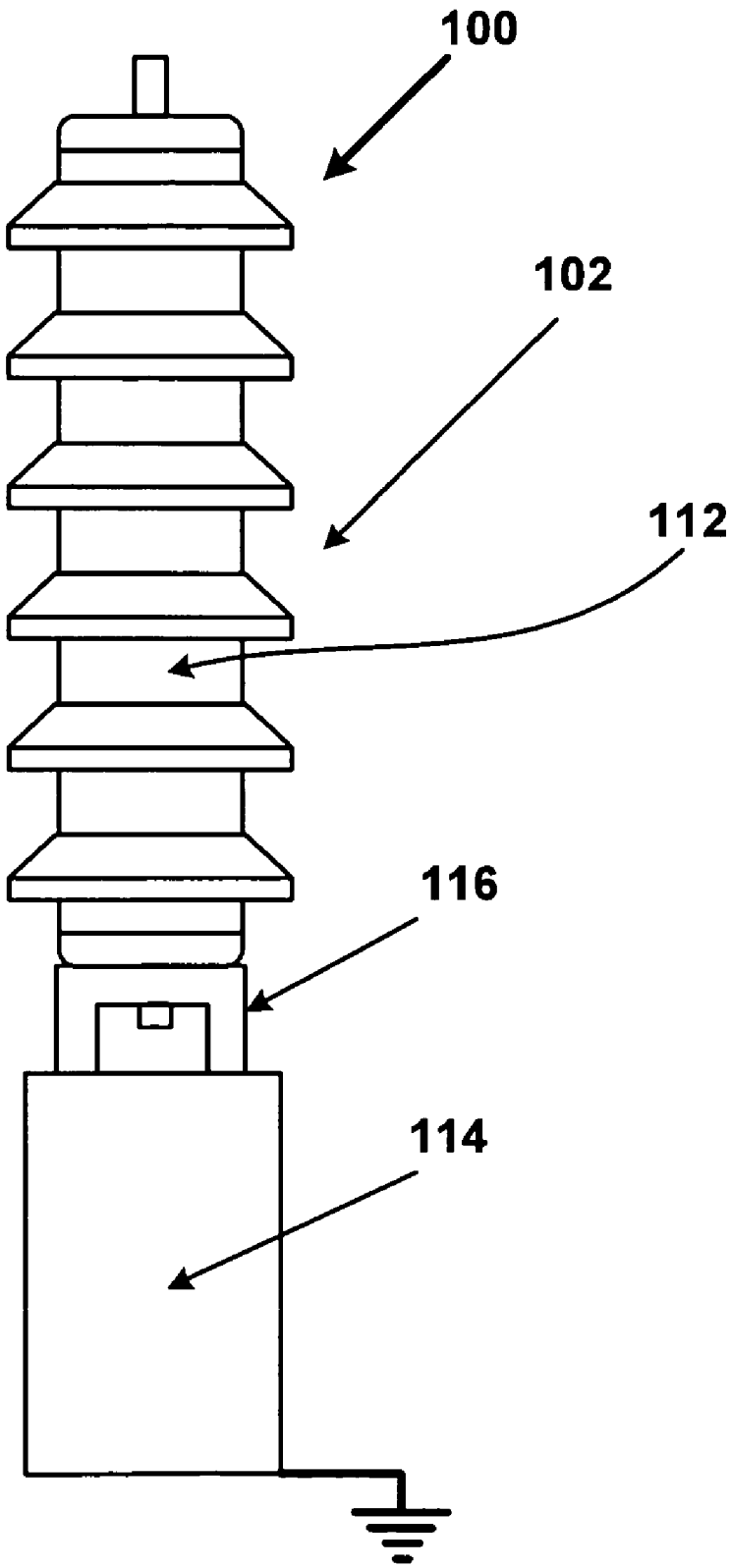
FIG. 8 is a front view of the choke.

Referring now to FIGS. 7 and 8, there is shown a choke 100 that may be used in combination with the transformer 10, particularly when the transformer 10 would otherwise be directly connected to a vacuum circuit breaker 90. The choke 100 is operable to suppress very fast transient (VFT) voltage phenomena that often arises as a result of the operation of vacuum circuit breakers. VFT voltage phenomena can damage insulation systems such as insulating resins.

The choke 100 comprises a series impedance element 102 and a capacitor 104. The impedance element 102 includes an inductor 106 connected in parallel with a resistor 108. As shown in FIG. 7, the inductor 106 and the resistor 108 may be cast into one or more resins so as to be encapsulated within an encasement 112. The encasement 112 may be formed from the same resins and in the same manner as the encasement 16. The capacitor 104 may be mounted inside a housing 114 and may be connected to the impedance element 102 by a conductive bus bar 116, which is also electrically connected to one of the terminals 40. The choke 100 may be mounted to the utility pole 60, adjacent to the transformer 10.

The resistor 108 has a resistance in a range from about 20-50 Ohms to provide wave termination. The inductor 106 is non-saturable with the working current and has an impedance value that is selected such that the voltage drop at 50 Hz is small in order not to generate heat in the resistor 108. The impedance of the inductor 106 is greater than the resistance of the resistor 108 at frequencies greater than 10 kHZ. The capacitance of the capacitor 104 is relatively small, having a value of about 5-20 nanofarads (nF), more particulary about 10 nF.

Three of the transformers 10 can be connected together to form a three-phase transformer that can be mounted to the utility pole 60. The high voltage (primary) windings of the transformers 10 can be connected together in a Delta configuration or a Wye configuration. Similarly, the low voltage (secondary) windings of the transformers 10 can be connected together in a Delta or Wye configuration.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A distribution transformer comprising:

a ferromagnetic core;

a plurality of coil assemblies mounted to the core, each of the coil assemblies comprising a low voltage coil and a high voltage coil, the low voltage coils being connected together and the high voltage coils being connected together;

an encasement comprised of an insulating resin and encapsulating the core and the coil assemblies, the encasement including:

a body having a central passage extending therethrough; and a pair of high voltage bushings extending outwardly from the body; and terminals extending from the high voltage bushings and being connected to the high voltage coils.

2. The distribution transformer of claim 1, wherein in each coil assembly, the low voltage coil and the high voltage coil are concentric.

3. The distribution transformer of claim 2, wherein in each coil assembly, the low voltage coil and the high voltage coil are each cylindrical.

4. The distribution transformer of claim 3, wherein the low voltage coil is disposed inside the high voltage coil.

5. The distribution transformer of claim 4, wherein the high voltage coil has a different axial length than the low voltage coil.

6. The distribution transformer of claim 2, wherein the low voltage coil has a longer axial length than the high voltage coil.

7. The distribution transformer of claim 2, wherein the body is substantially annular in shape and each of the high voltage bushings is substantially frusto-conical in shape.

8. The distribution transformer of claim 7, further comprising:

helical coils disposed in the high voltage bushings, respectively; and leads connecting the high voltage coils to the terminals, respectively, the leads extending through the helical coils.

9. The distribution transformer of claim 8, wherein the helical coils are connected to the terminals, respectively.

10. The distribution transformer of claim 7, wherein the insulating resin comprises an epoxy resin.

11. The distribution transformer of claim 10, wherein the epoxy resin is a cycloaliphatic epoxy resin.

12. The distribution transformer of claim 10, further comprising a plurality of mounting inserts molded into the encasement and extending outwardly therefrom.

13. The distribution transformer of claim 2, wherein the low voltage coils are connected in series and the high voltage coils are connected in series.

14. The distribution transformer of claim 2, wherein the low voltage coils are connected in parallel and the high voltage coils are connected in parallel.

15. A power distribution installation for connection to power lines extending above a ground surface, the power distribution installation comprising:

an upwardly-extending utility pole for supporting the power lines above the ground surface; and a distribution transformer mounted to the utility pole so as to be elevated above the ground surface, the distribution transformer comprising:

a ferromagnetic core;

a plurality of coil assemblies mounted to the core, each of the coil assemblies comprising a low voltage coil and a high voltage coil, the low voltage coils being connected together and the high voltage coils being connected together;

an encasement comprised of an insulating resin and encapsulating the core and the coil assemblies, the encasement including:

a body having a central passage extending therethrough; and a pair of high voltage bushings extending outwardly from the body; and terminals for connection to the power lines, the terminals extending from the high voltage bushings and being connected to the high voltage coils.

16. The power distribution installation of claim 15, wherein in each coil assembly, the low voltage coil is concentrically disposed within the high voltage coil.

17. The power distribution installation of claim 16, wherein the body is substantially annular in shape and each of the high voltage bushings is substantially frusto-conical in shape.

18. The power distribution installation of claim 15, further comprising a plurality of mounting inserts molded into the encasement and extending outwardly therefrom.

19. The power distribution installation of claim 18, further comprising a frame that mounts the transformer to the utility pole, the frame comprising at least one bracket secured to the mounting inserts.

20. The power distribution installation of claim 15, wherein the insulating resin comprises a cycloaliphatic epoxy resin.

* * * * *